US007811390B2

(12) United States Patent
Ishii et al.

(10) Patent No.: US 7,811,390 B2
(45) Date of Patent: Oct. 12, 2010

(54) METHOD FOR PRODUCING CARBURIZED PARTS

(75) Inventors: Kazuo Ishii, Saitama (JP); Tatsumi Tanaka, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/053,394

(22) Filed: Mar. 21, 2008

(65) Prior Publication Data

US 2008/0230153 A1 Sep. 25, 2008

(30) Foreign Application Priority Data

Mar. 23, 2007 (JP) ..... 2007-077349

(51) Int. Cl.

| | |
|---|---|
| ***C23C 8/02*** | (2006.01) |
| ***C23C 8/04*** | (2006.01) |
| ***C23C 8/06*** | (2006.01) |
| ***C23C 8/10*** | (2006.01) |
| ***C23C 8/20*** | (2006.01) |

(52) U.S. Cl. ..... 148/210; 148/217; 148/223

(58) Field of Classification Search ..... 148/210, 148/217, 223

See application file for complete search history.

(56) References Cited

U.S. PATENT DOCUMENTS

| | | | | |
|---|---|---|---|---|
| 3,885,995 | A | 5/1975 | Cunningham et al. | |
| 6,187,111 | B1 | 2/2001 | Waka et al. | |
| 2002/0037120 | A1 * | 3/2002 | Tanaka et al. | 384/492 |
| 2007/0044866 | A1 * | 3/2007 | Morita et al. | 148/319 |

FOREIGN PATENT DOCUMENTS

| | | | |
|---|---|---|---|
| EP | 0 867 524 | B1 | 7/2002 |
| JP | 50-1930 | | 1/1975 |
| JP | 04-032537 | A | 2/1992 |
| JP | 04-250927 | A | 9/1992 |
| JP | 05-025610 | A | 2/1993 |
| JP | 08-060335 | A | 3/1996 |
| JP | 09-324255 | * | 12/1997 |
| JP | 09-324255 | A | 12/1997 |
| JP | 10-273771 | A | 10/1998 |
| JP | 11-315363 | A | 11/1999 |
| JP | 2002-180235 | A | 6/2002 |
| JP | 2003-147506 | A | 5/2003 |
| JP | 2004-332074 | A | 11/2004 |
| JP | 2006-028541 | A | 2/2006 |

OTHER PUBLICATIONS

Freiburg et al., "Investigation oxide films on ferritic stainless steel," Fresenius J. Anal. Chem. (1991) 341:427-431.*

* cited by examiner

*Primary Examiner*—Timothy C Vanoy
*Assistant Examiner*—Daniel Berns
(74) *Attorney, Agent, or Firm*—Arent Fox LLP

(57) ABSTRACT

A method for producing a carburized part by carburizing a steel member under a vacuum in a decompression furnace while feeding carburizing gas comprises a step for forming an oxide film on at least a part of a surface of the steel member, a step for generating carbon by reducing the oxide film with the carburizing gas, and a step for carburizing the surface of the steel member under a vacuum by diffusing the carbon.

1 Claim, 4 Drawing Sheets

METHOD FOR PRODUCING CARBURIZED PARTS

BACKGROUND OF THE INVENTION

1. Technical Field

The present invention relates to a method for producing a carburized part by carburizing a steel member under a vacuum.

2. Background Art

Carburization treatment for improving strength of a surface of steel materials is conventionally performed by a method such as gas carburization and vacuum carburization. For example, in gas carburization, as a method for improving a carburizing property by a preliminary oxidation, a method for carburizing a high-alloy steel after a preliminary oxidation (Japanese Unexamined Patent Application Publication No. 50-1930), and a method for carburizing after a preliminary oxidation under reduced pressure (Japanese Unexamined Patent Application Publication No. 9-324255) are known. Moreover, as a method for producing a carburized part under reduced pressure, a method for carburizing and nitriding in succession in a decompression furnace (Japanese Unexamined Patent Application Publication No. 2006-28541), a method for rapidly carburizing under reduced pressure by using ethylene gas (Japanese Unexamined Patent Application Publication No. 11-31536), and a method for rapidly carburizing under reduced pressure by feeding carburizing gas in pulses (Japanese Unexamined Patent Application Publication No. 2004-332074) are known. Furthermore, as a method for partially carburizing or for partially changing a depth or a concentration of carburization, a method for partially carburizing by using an anti-carburizer (Japanese Unexamined Patent Application Publications No. 10-273771 and No. 4-32537), a method for partially carburizing by using a plating (Japanese Unexamined Patent Application Publication No. 8-60335), a method for controlling a depth of carburization by utilizing a plastic deformation (Japanese Unexamined Patent Application Publication No. 5-25610), and a method for removing unnecessary portions by grinding or cutting after high concentration carburization (Japanese Unexamined Patent Application Publication No. 4-250927) are known.

In gas carburization, an intergranular oxidation layer is formed on a surface of a steel material, and it functions as an initial crack, whereby fatigue strength may be decreased. Moreover, elements effective for quenching are oxidized, and metallic structure is insufficiently quenched, whereby pitting strength may be decreased. On the other hand, carburization under reduced pressure (a vacuum) is a method effective for improving pitting strength because the intergranular oxidation layer is not formed. However, the cost of equipment for reducing pressure is high, and therefore, a method for carburizing as rapidly as possible is required. Properties of some products may be improved by partially carburizing, but both the gas carburization and the decompressed carburization using conventional techniques take substantial amounts of time and effort.

SUMMARY OF THE INVENTION

An object of the present invention is to provide a method for producing a carburized part. In the method, decompressed carburization can be rapidly performed, thereby reducing processing time and amount of carburizing gas used. Moreover, a product having partially different concentration of carburization is easily obtained by the method.

An oxide film formed on a surface of a steel member was thought to retard carburization treatment. However, the inventors have found that an oxide film having a certain range of thickness actually accelerates the carburization reaction occurring during decompressed carburization, and the present invention has thereby been completed. That is, the present invention provides a method for producing a carburized part by carburizing a steel member under a vacuum in a decompression furnace feeding carburizing gas. The method comprises a step for forming an oxide film on at least a part of a surface of the steel member, a step for generating carbon by reducing the oxide film with the carburizing gas, and a step for carburizing the surface of the steel member under a vacuum by diffusing the carbon. In the present invention, the thickness of the oxide film is preferably adjusted to be in a range of 0.05 to 5 μm.

According to the present invention, carburization under reduced pressure can be accelerated, whereby carburization time and running cost are reduced, and high concentration carburization is easily performed. Moreover, partial carburization, which is difficult to perform by conventional techniques, can be easily performed by the present invention.

PREFERRED EMBODIMENTS OF THE INVENTION

Figure 1:
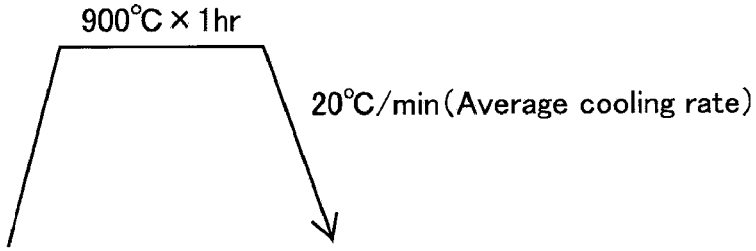
FIG. 1 is a diagram showing an example of a heating pattern for a normalizing treatment before carburization treatment.

First, a function of the present invention will be described.

1. Carburization Reaction with Hydrocarbon

Carburization reaction with hydrocarbon such as propane, ethylene, acetylene, and the like proceeds under a reduced-pressure atmosphere according to diffusion of carbon produced by decomposition of hydrocarbons.

$$C_nH_m \rightarrow nC + \frac{m}{2}H_2 \quad (1)$$

In the case of decompressed carburization, whereas gas is continuously drawn by a vacuum pump, hydrocarbons for carburization are fed. Therefore, the above reaction will not be in an equilibrium state, and the carburization reaction continuously proceeds. Specifically, in a reduced pressure atmosphere, a method called "pulse carburization", in which carburizing gas is intermittently fed, is often used, and it is important to accelerate the carburization reaction while the carburizing gas is fed. In this case, a means for improving a rate of carburization is examined from a viewpoint of a free-energy change. The free-energy change in the formula 1, "$\Delta G_1$", is defined by the following formula.

$$\Delta G_1 = n\Delta G_C^0 + \frac{m}{2}\Delta G_{H_2}^0 - \Delta G_{C_nH_m}^0 + RT\ln K_1 \quad (2)$$

$\Delta G_x^0$: free energy of formation of X

R: gas constant

T: temperature

In this case, "$K_1$" represents a ratio of concentration in the formula 1.

$$\Delta G_1 = n\Delta G_C^0 + \frac{m}{2}\Delta G_{H_2}^0 - \Delta G_{C_nH_m}^0 + RT\ln K_1 \quad (3)$$

$$K_1 = \frac{a_C^n p_{H_2}^{\frac{m}{2}}}{p_{C_nH_m}} \quad (4)$$

$p_{C_nH_m}$: partial pressure of $C_nH_n$ $p_{H_2}$: partial pressure of $H_2$ $a_C$: concentration (activity) of C $$\Delta G_1 = n\Delta G_C^0 + \frac{m}{2}\Delta G_{H_2}^0 - \Delta G_{C_nH_m}^0 + RT\ln K_1 \quad (5)$$

$\Delta G_C^0=0$, $\Delta G_{H_2}^0=0$, whereby the formula 3 can be represented by the following formula.

$$\Delta G_1 = -\Delta G_{C_nH_m}^0 + RT\ln K_1 \quad (6)$$

The reaction of the formula 1 occurs when $\Delta G_1$ is negative, and it can be accelerated by adjusting $\Delta G_1$ to a negative value that is as low as possible. Therefore, it is effective to adjust $K_1$ to a small value and to adjust T to a large value. That is, in a condition of decompressed carburization, $K_1<1$, and $RT\ln K_1$ becomes a negative value according to the following formula.

$$p_{C_nH_m} > p_{H_2} \quad (7)$$

In order to set $K_1$ to a small value, according to the formula 3, it is effective to increase the partial pressure of the hydrocarbon and to decrease the partial pressure of hydrogen. However, the improvement of these conditions is limited under the conditions of the decompressed carburization.

The effect of the increasing of T, that is, raising temperature, is generally known, but the temperature should be set to 1000° C. or higher so as to further reduce carburization time, and various undesirable effects thereby follow. For example, if an allowable temperature limit of a furnace of a carburization device is to be improved, the design of the device must be substantially modified. In addition, the service life of a heater may be decreased, and maintenance must be frequently performed, whereby an operation rate is decreased. Moreover, effects on an object to be carburized cannot be avoided. That is, properties of a steel material may deteriorate because crystal grains of the steel material become coarser, and strain is increased during heat treatment. Thus, reducing of carburization time by raising the temperature has disadvantages.

2. Effect of an Oxide Film

In surface treatment and surface modification as represented by carburization, an oxide film is generally supposed to be an obstruction, and it is removed as much as possible. This is because the oxide film functions as a barrier film during a surface treatment, and it often undesirably affects a reaction and an adhesion at a surface. However, the inventors have found that an oxide film formed before carburization accelerates carburization during decompressed carburization. The function will be described by using reaction formulas.

Carburization reaction when an oxide film $Fe_xO_y$ exists is represented by the following formula.

$$C_nH_m + \frac{m}{2y}Fe_xO_y \rightarrow nC + \frac{mx}{2y}Fe + \frac{m}{2}H_2O \quad (8)$$

Free energy change $\Delta G_8$ of the formula 8 can be defined by the following formula.

$$\begin{aligned}\Delta G_8 &= n\Delta G_C^0 + \frac{mx}{2y}\Delta G_{Fe}^0 + \frac{m}{2}\Delta G_{H_2O}^0 - \Delta G_{C_nH_m}^0 - \\ &\quad \frac{m}{2y}\Delta G_{Fe_xO_y}^0 + RT\ln K_8 \\ &= \frac{m}{2}\Delta G_{H_2O}^0 - \Delta G_{C_nH_m}^0 - \frac{m}{2y}\Delta G_{Fe_xO_y}^0 + RT\ln K_8\end{aligned} \quad (9)$$

In this case, $K_8$ is represented by the following formula.

$$K_8 = \frac{a_C^n p_{H_2O}^{\frac{m}{2}} a_{Fe}^{\frac{mx}{2y}}}{p_{C_nH_m} a_{Fe_xO_y}^{\frac{m}{2y}}} \quad (10)$$

$p_{H_2O}$: partial pressure of water vapor $a_{Fe}$: concentration (activity) of Fe $a_{Fe_xO_y}$: concentration (activity) of $Fe_xO_y$ In this case, a condition under which the reaction of the formula 8 proceeds more than the reaction of the formula 1 has been investigated. In this condition, $\Delta G_1$ in the formula 6 and $\Delta G_8$ in the formula 9 are used so as to obtain a relationship of $\Delta G_1 > \Delta G_8$. Then, this condition is rewritten as follows.

$$\Delta G_1 - \Delta G_8 > 0$$

In this case, the above condition can be represented by the following formula according to the formulas 6 and 9.

$$\Delta G_1 - \Delta G_8 = \frac{m}{2y}\Delta G^0_{Fe_xO_y} - \frac{m}{2}\Delta G^0_{H_2O} + RT\ln\frac{K_1}{K_8} = \frac{m}{2}\left(\frac{1}{y}\Delta G^0_{Fe_xO_y} - \Delta G^0_{H_2O}\right) + RT\ln\frac{K_1}{K_8} \quad (11)$$

The formulas 3 and 10 are substituted for the formula II so that $K_1/K_8$ can be represented by the following formula.

$$\frac{K_1}{K_8} = \frac{a_C^n p_{H_2}^{\frac{m}{2}}}{p_{C_nH_m}} \cdot \frac{p_{C_nH_m} a_{Fe_xO_y}^{\frac{m}{2y}}}{a_C^n p_{H_2O}^{\frac{m}{2}} a_{Fe}^{\frac{mx}{2y}}} = \frac{p_{H_2}^{\frac{m}{2}} a_{Fe_xO_y}^{\frac{m}{2y}}}{p_{H_2O}^{\frac{m}{2}} a_{Fe}^{\frac{mx}{2y}}} \quad (12)$$

In this case, if a degree of vacuum is maintained, the following formula 13 can be assumed, whereby the formula 12 is represented by the following formula 14.

$$p_{H_2O} = p_{H_2} \quad (13)$$

$$\frac{K_1}{K_8} = \frac{a_{Fe_xO_y}^{\frac{m}{2y}}}{a_{Fe}^{\frac{mx}{2y}}} \quad (14)$$

The formula 14 is substituted for the formula 11, and the following formula is obtained.

$$\Delta G_1 - \Delta G_8 = \frac{m}{2}\left(\frac{1}{y}\Delta G^0_{Fe_xO_y} - \Delta G^0_{H_2O}\right) + RT\ln\left(\frac{a_{Fe_xO_y}^{\frac{m}{2y}}}{a_{Fe}^{\frac{mx}{2y}}}\right) \quad (15)$$

In this case, a member to be carburized is assumed to be completely covered with an oxide film, and the formula 15 is calculated by using the following formulas.

$$a_{Fe_3O_4}=1 \quad (16)$$

$$a_{Fe}=0 \quad (17)$$

As a result, the second term of the formula 15 diverges to infinity, thereby satisfying $\Delta G_1-\Delta G_8>0$. That is, carburization can be accelerated regardless of temperature, the type of carburizing gas, and the type of oxide film. This condition is obtained when an ordinary oxidation treatment is performed, and every carburizing gas may have the effect (It should be noted that m>0).

Assuming that an oxide film includes some defects, the formula 15 is calculated in a condition in which the oxide film is 99% and iron-based material is 1%. In this example, ethylene ($C_2H_4$) is used as carburizing gas, and $Fe_2O_3$ is used as the oxide film.

$$\Delta G_{Fe_2O_3}=-580 \text{ kJ/mol} \quad (18)$$

$$\Delta G_{H_2O}{}^0=-197 \text{ kJ/mol} \quad (19)$$

Since m=4, and y=3, the first term of the formula 15 will be 7 kJ/mol. The second term will be 99 kJ/mol according to the following formulas.

$$a_{Fe_3O_4}=0.99 \quad (20)$$

$$a_{Fe}=0.01 \quad (21)$$

Therefore, $\Delta G_1-\Delta G_8=106$ kJ/mol, thereby satisfying $\Delta G_1-\Delta G_8>0$. According to this calculation, $\Delta G_1-\Delta G_8$ is calculated with respect to gas used in practice in decompressed carburization, and the results are shown in Table 1. As shown in Table 1, every condition satisfies the relationship of $\Delta G_1-\Delta G_8>0$.

TABLE 1

| Carburizing gas | m | Oxide film | Temperature (° C.) | 600 | 700 | 800 | 900 | 1000 | 1500 |
|---|---|---|---|---|---|---|---|---|---|
| Acetylene | 2 | FeO | | 30 | 35 | 41 | 47 | 52 | 79 |
| | | $Fe_3O_4$ | | 88 | 102 | 116 | 130 | 291 | 211 |
| | | $Fe_2O_3$ | | 62 | 73 | 84 | 95 | 106 | 158 |
| Ethylene, Methane | 4 | FeO | | 26 | 34 | 41 | 48 | 55 | 91 |
| | | $Fe_3O_4$ | | 75 | 93 | 109 | 125 | 437 | 219 |
| | | $Fe_2O_3$ | | 57 | 72 | 87 | 101 | 114 | 181 |
| Ethane | 6 | FeO | | 23 | 32 | 41 | 50 | 59 | 103 |
| | | $Fe_3O_4$ | $\Delta G_1$-$\Delta G_8$ | 63 | 83 | 102 | 121 | 582 | 227 |
| | | $Fe_2O_3$ | (kJ/mol) | 53 | 71 | 89 | 106 | 123 | 204 |
| Propane | 8 | FeO | | 19 | 30 | 41 | 52 | 62 | 114 |
| | | $Fe_3O_4$ | | 50 | 74 | 95 | 116 | 727 | 235 |
| | | $Fe_2O_3$ | | 48 | 70 | 91 | 112 | 131 | 226 |
| Pentane | 12 | FeO | | 12 | 27 | 41 | 55 | 69 | 137 |
| | | $Fe_3O_4$ | | 25 | 54 | 82 | 107 | 1018 | 251 |
| | | $Fe_2O_3$ | | 39 | 68 | 96 | 123 | 148 | 271 |

It should be noted that the following formula represents coverage in a micro region of an oxide film, and it is not a macro-area ratio of an oxide film on a surface of a portion to be carburized.

$$a_{Fe_3O_4}=0.99 \quad (22)$$

In an investigation of a chemical reaction, a probability of encountering reactive molecules within a mean-free path of molecules of carburizing gas (a moving distance in which the molecule travels between collisions with other moving molecules) is important, and a concentration and a coverage are parameters that should be considered from this point of view.

According to the above theoretical consideration, the existence of an oxide film accelerates carburization reactions occurring during decompressed carburization.

3. Oxide Film Having an Actual Effect

As described above, the existence of an oxide film accelerates carburization reactions. An oxide film with several nanometers thick may practically be formed simply by disposing a steel material in the atmosphere before carburization, and this is according to the following formula.

$$a_{Fe_xO_y}=1 \quad (23)$$

Such an oxide film has no effect because when a carburization treatment is started, the oxide film is reduced according to the reaction of the formula 8, and the abundance of the oxide film is thereby suddenly decreased. Therefore, in order to obtain an effective oxide film in a real operation, a certain amount of the oxide film is required so that the oxide film is maintained during the real operation without depletion, that is, a certain thickness of oxide film is required. On the other hand, the oxide film substantially functions as a barrier film. If the oxide film has a sufficient thickness to prevent the diffusion step of carbon to a large degree, the carbon, which is produced, cannot diffuse, whereby they remain at a surface of a steel material as "soot".

As described above, the effect of the present invention may not be obtained when the oxide film is too thin, and the oxide film may function as an obstruction to carburization when it is too thick. Therefore, there may be a suitable thickness of the oxide film that is formed preliminary. The inventors have repeatedly experimented and found the optimum conditions for forming an oxide film, and the range of the optimum conditions will be described hereinafter.

EXAMPLES

A. Investigations of Effect and Suitable Film Thickness of Formed Oxide Film In the present invention, the effect can be obtained by using every steel regardless of its compositions. In this case, an example of using a steel defined by JIS SCM420H, which is generally used as a steel to be carburized, will be described. The chemical composition of a material used in the experiments is shown in Table 2.

TABLE 2

| Fe | C | Si | Mn | P | S | Cr | Mo |
|---|---|---|---|---|---|---|---|
| Bal. | 0.22 | 0.24 | 0.70 | 0.02 | 0.03 | 1.05 | 0.16 |

This material was normalized under the conditions shown in FIG. 1, and the structure thereof was adjusted. This adjustment is a general treatment for securing hardness of a material after forging, and it is not a condition which limits the scope of the present invention. After the surface of the material was polished with #80 emery paper, it was finally polished with #1200 emery paper. Then, the material was preliminary oxidized under the conditions shown in Table 3.

TABLE 3

| No. | Atmosphere | Temperature (° C.) | Time (min) | Film thickness (μm) | |
|---|---|---|---|---|---|
| 1 | The air | As-polished | | 0.009 | Comparative examples |
| 2 | | 200 | 15 | 0.02 | |
| 3 | | 250 | 15 | 0.05 | Examples |
| 5 | | 250 | 60 | 0.09 | |
| 6 | | 300 | 15 | 0.2 | |

TABLE 3-continued

| No. | Atmosphere | Temperature (° C.) | Time (min) | Film thickness (μm) | |
|---|---|---|---|---|---|
| 8 | | 300 | 60 | 0.39 | |
| 9 | | 400 | 15 | 0.77 | |
| 10 | | 400 | 60 | 1.4 | |
| 11 | | 500 | 15 | 3.5 | |
| 12 | | 550 | 60 | 5 | |
| 13 | | 600 | 15 | 8.2 | Comparative example |

Figure 2:
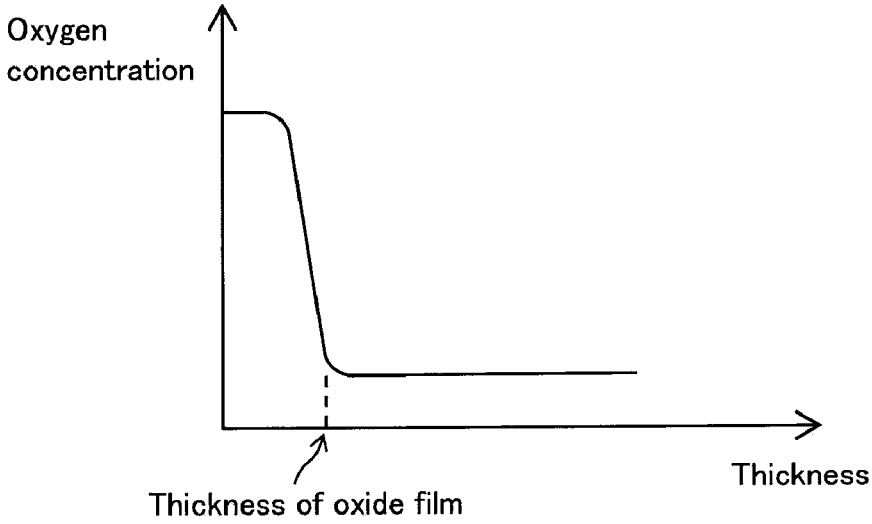
FIG. 2 is a diagram showing a method for measuring a thickness of an oxide film based on EPMA.
Figure 3:
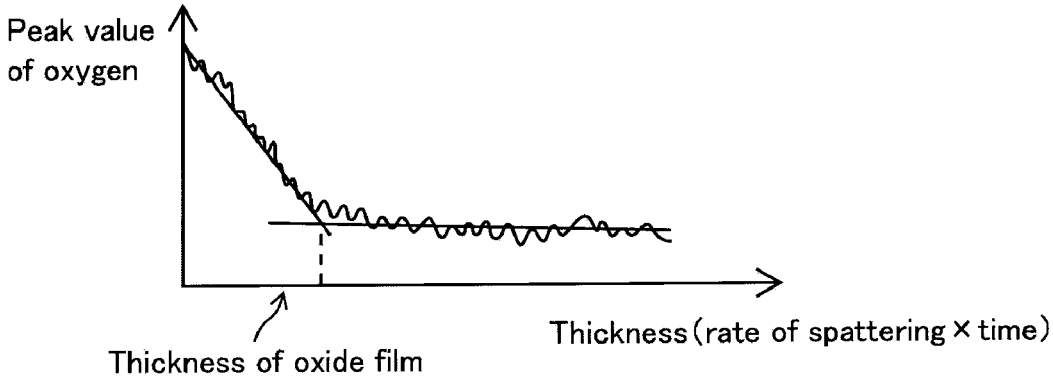
FIG. 3 is a diagram showing a method for measuring a thickness of an oxide film based on AES.

Next, thickness of an oxide film on the surface of each specimen was measured by the following method. A specimen having film thickness of 0.1 μm or more was polished at the cross section, and a distribution state of oxygen was analyzed at the cross section by a line analysis of EPMA (Electron Probe X-ray Micro Analyzer). According to a distribution curve shown in FIG. 2, thickness of an oxide film was measured from an intersection point of a downward curve and a constant line of concentration in depth direction. A specimen having film thickness of not more than 0.1 μm was analyzed by AES (Auger Electron Spectroscopy) using spatter so as to observe a distribution of oxygen in the depth direction. As shown in FIG. 3, the thickness of an oxide film was measured from an intersection point of a downward curve and a constant line of peak value in the depth direction. In practice, the specimens were measured by EPMA, and then some specimens which could not be measured by EPMA were measured by AES. The results are also shown in Table 3.

Figure 4:
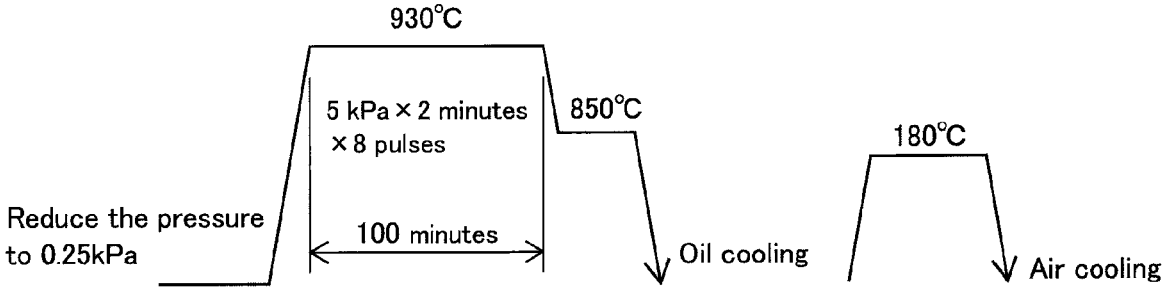
FIG. 4 is a diagram showing an example of a carburizing condition (heating pattern) of the present invention.

Then, these specimens were carburized under the conditions shown in FIG. 4. The carburization was performed such that the specimens were disposed in an airtight container, and the inside of the container was decompressed to 0.25 kPa ($2.5\times10^{-3}$ atm) and was heated to a certain temperature by an electrical resistance heater. Ethylene was used as the carburizing gas, and a carburizing atmosphere was formed by intermittently feeding ethylene to the container at 5 kPa ($5\times10^{-2}$ atm) for 2 minutes at 8 times, that is, pulse decompressed carburization was performed. This condition is generally used in decompressed carburization, and it does not limit the scope of application of the present invention.

Figure 5:
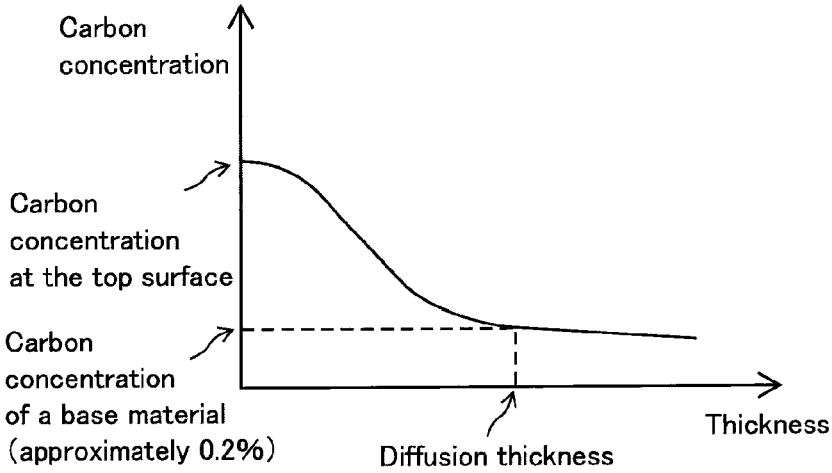
FIG. 5 is a diagram showing distribution characteristic of carbon concentration according to a line analysis of EPMA.

The specimen carburized thus was cut off, and the section was analyzed by the line analysis of EPMA so as to measure a depth distribution of carbon concentration. The depth distribution of carbon concentration showed distribution characteristics as shown in FIG. 5, and a distance between the top surface and a depth in which the carbon concentration was approximately the same as that of the base material was measured as a diffusion depth. In the same specimen, hardness of the section was measured by Vickers hardness tester, and an effective depth of the hardened layer was measured from a hardness profile at Hv=550 obtained by the hardness test. This procedure is based on JIS G 0557. The results are shown in Table 4.

TABLE 4

| No. | Film thickness (μm) | Cabon concentration at the top surface (%) | Diffusion depth (mm) | Effective depth of hardened layer (mm) | |
|---|---|---|---|---|---|
| 1 | 0.009 | 0.69 | 1.0 | 0.50 | Comparative examples |
| 2 | 0.02 | 0.71 | 1.0 | 0.50 | |

TABLE 4-continued

| No. | Film thickness (μm) | Cabon concentration at the top surface (%) | Diffusion depth (mm) | Effective depth of hardened layer (mm) | |
|---|---|---|---|---|---|
| 3 | 0.05 | 0.80 | 1.0 | 0.50 | Examples |
| 5 | 0.09 | 0.91 | 1.1 | 0.55 | |
| 6 | 0.2 | 1.11 | 1.1 | 0.57 | |
| 8 | 0.39 | 1.19 | 1.1 | 0.60 | |
| 9 | 0.77 | 1.10 | 1.1 | 0.60 | |
| 10 | 1.4 | 1.03 | 1.1 | 0.55 | |
| 11 | 3.5 | 1.05 | 1.1 | 0.54 | |
| 12 | 5 | 0.95 | 1.1 | 0.54 | |
| 13 | 8.2 | 0.55 | 1.0 | 0.40 | Comparative example |

According to the results shown in Table 4, the diffusion depth of carbon is not much changed with respect to the change in the thickness of oxide films, but the carbon concentration at the surface and the effective depth of the hardened layer are changed. As estimated above, this indicates that the oxide film accelerates the carburization reaction of the surface. On the other hand, the diffusion depth may represent the effect of diffusion time during carburization treatment rather than the effect of the oxide film. Since the effective depth of the hardened layer depends on the carbon concentration at an intermediate point between the surface and the diffusion depth, it is affected by the carbon concentration at the surface, whereby it is affected by the thickness of the oxide film.

The inventors have investigated whether or not carburization is accelerated by a relationship of the carbon concentration at the top surface and the thickness of an oxide film formed by preliminary oxidation. As shown in Table 4, when the thickness of the oxide film is 0.05 μm or more, there is an accelerating effect for carburization. When the oxide film has thickness of more than 5 μm, it functions as a barrier film and inhibits carburization. Therefore, a suitable thickness of the oxide film in the present invention is 0.05 to 5 μm. Specifically, when the thickness of the oxide film is in a range of 0.2 to 3.5 μm, the oxygen concentration at the surface is extremely improved, and a great effect can be obtained.

In the above experiments, the accelerating effect for carburization was verified by using carbon concentration as a parameter under conditions in which the carburization time was fixed. In order to form a carburized part having a carbon concentration at the same level as that of a portion formed by conventional techniques, carburization can be performed in short periods by using the present invention, whereby the running cost, particularly, the amount of carburizing gas used, can be reduced.

B. Suitable Conditions for Obtaining Effects by the Present Invention Temperature of Preliminary Oxidation According to the results shown in Table 4, the accelerating effect for carburization is obtained when the temperature is not more than 550° C., but the carburization is inhibited when the temperature is 600° C. This is because FeO is formed inside the oxide film when the temperature is 570° C. or higher, and the film may grow and become thick, whereby the oxide film effectively functions as a barrier with respect to the diffusion of carbon. However, when carburization is performed under conditions in which the thickness of an oxide film is decreased by removing the top surface of the oxide film using a surface treatment such as a shot blasting after preliminary oxidation is performed at 570° C. or higher, the accelerating effect for carburization can be obtained. Accordingly, the thickness of an oxide film is more important than the temperature of oxidation, but in order to avoid additional steps, the temperature of preliminary oxidation is preferably set at 250 to 550° C.

In a conventional technique that is thought to be similar to the present invention, it is known that a preliminary oxidation is effective as a pretreatment for gas carburization for high-alloy steel such as stainless steel (see Japanese Unexamined Patent Application Publication No. 50-1930). In this case, the purpose of the preliminary oxidation is to decrease a function of an oxide film as a barrier during gas carburization by forming a thick oxide layer so that the oxide layer may break away and be porous. Therefore, the preliminary oxidation disclosed in the conventional technique is completely different from the treatment of the present invention, which is designed to accelerate carburization during decompressed carburization. In Japanese Unexamined Patent Application Publication No. 50-1930, oxidation is preferably performed at 1800° F. (approximately 985° C.) for 0.5 to 1 hour, and the conditions are obviously different from the conditions of the present invention.

Time of Preliminary Oxidation

An oxide film does not break away at a temperature within the above range and grows parabolically, and the time of heat treatment can be selected within the time estimated by the following formula.

$$d=\sqrt{k^2t+d_0^2} \tag{24}$$

d: film thickness $d_0$: initial film thickness (film thickness naturally produced)

k: rate constant t: time

In general, since $d_0$ is very small with respect to a film produced by oxidation, it is approximated to 0. For example, as shown in Table 3, when the temperature is 300° C., t=60 minutes and d=0.39, whereby k can be estimated to be 0.050 (in this case, $d_0$=0). Since the maximum thickness of an oxide film having an effect in the present invention is 5 μm, the time for producing an oxide film of 5 μm can be calculated to be $4.9\times10^3$ minutes (in this case, $d_0$=0) according to the following formula.

$$t=\frac{d^2-d_0^2}{k^2} \tag{25}$$

Atmosphere of Preliminary Oxidation

The examples of the present invention shown in Tables 3 and 4 show results of oxidation in air. Whether oxides are produced or not depends on the oxygen partial pressure. For example, as shown in the examples of the present invention, when the temperature is 550° C., the equilibrium oxygen partial pressure of $Fe_2O_3$ is approximately $10^{-11}$ Pa ($10^{-16}$ atm), and therefore, the oxygen partial pressure should be higher than $10^{-11}$ Pa. In order to accelerate the oxidation reaction, a higher oxygen partial pressure is preferable, and an oxygen partial pressure of 10 Pa ($10^{-4}$ atm) or more is more preferable. Such an oxygen concentration can be formed in the air without any atmosphere control, and no limit is specified. It should be noted that when $H_2$ or CO coexists, the present invention can be performed in a condition in which the oxygen potential is at not less than a degree corresponding to $10^{-11}$ Pa ($10^{-16}$ atm).

For example, when the following reaction occurs at 550° C., by setting the ratio of partial pressures according to the formula 27, the oxygen partial pressure can be represented as the formula 28.

$$CO + \frac{1}{2}O_2 = CO_2 \tag{26}$$

$$\frac{P_{CO}}{P_{CO_2}} \geqq 10^5 \tag{27}$$

$$P_{O_2} \geqq 10^{-11}\ \text{Pa}(10^{-16}\ \text{atm}) \tag{28}$$

As a method for obtaining effects by gas carburization, a method is disclosed in Japanese Unexamined Patent Application Publication No. 9-324255 in which gas carburization performed after preliminary oxidation is performed at an oxygen partial pressure of $10^{-14}$ to 10 Pa ($10^{-19}$ to $10^{-4}$ atm). In this case, the temperature of preliminary heat treatment is 750° C., and the dissociation oxygen partial pressure of $Fe_2O_3$ is $10^{-5}$ Pa ($10^{-10}$ atm), whereby a stable oxide film cannot be formed when the oxygen partial pressure is $10^{-5}$ Pa or less. In this document, since the amount of formed oxide film is not disclosed, some effects of modifying a surface, such as removal of oil adhering to a surface under a high vacuum of $10^{-19}$ to $10^{-4}$ atm ($10^{-14}$ Pa to 10 Pa), may be larger than the effect of forming an oxide film. Therefore, an oxide film having a thickness that is required in the present invention cannot be obtained by the method disclosed in the above document, and the above preliminary oxidation does not have an effect as a pretreatment for decompressed carburization.

Material to be Carburized

In general, all kinds of steel may be used as the steel material to be carburized. In a case of a steel material including Cr of not less than 10%, a spinel-type oxide ($FeO.Cr_2O_3$) is mainly formed, and a growth rate of film thickness differs from that of a case in which ferrioxides are mainly formed, whereby suitable oxidation conditions also differ therefrom. In this case, the oxide film also has an accelerating effect on carburization, and the present invention can be used. Specifically, since a steel material including Cr at not more than 10% such as carbon steels, SCR materials (chrome steels), SCM materials (chrome molybdenum steels), SNC materials (nickel chrome steels), and SNCM materials (nickel chrome molybdenum steels) form an oxide film primarily containing ferrioxides, the present invention can be used, and the object of the present invention can be achieved under the conditions of preliminary oxidation shown in the examples.

Method of Preliminary Oxidation

Figure 6:
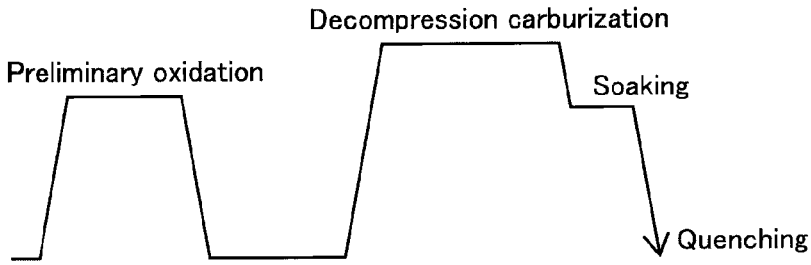
FIG. 6 is a diagram showing an example of a heating pattern for a preliminary oxidation when separate furnaces are used.

In a method of preliminary oxidation, as shown in FIG. 6, a material may be preliminary oxidized once and cooled in a separate furnace before decompressed carburization, and the material may be carburized in a decompressed carburizing furnace. According to the method, carburizing treatment can be partially performed by partially removing the formed oxide film, and using a separate furnace in such a way is useful in order to perform partial carburization.

Figure 7:
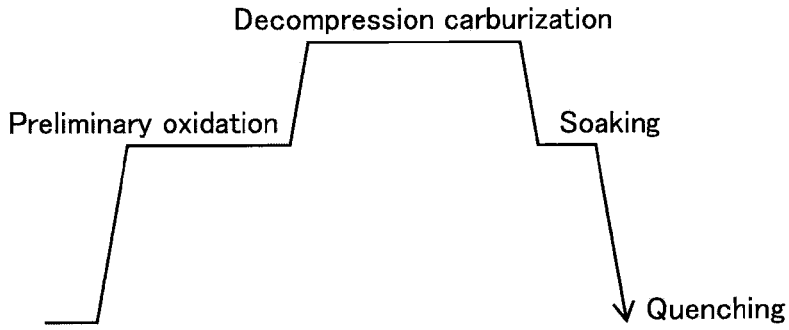
FIG. 7 is a diagram showing an example of a heating pattern for a preliminary oxidation when a continuous furnace is used.

On the other hand, as a method that is different from the above method, as shown in FIG. 7, preliminary oxidation and decompressed carburization may be successively performed. This treatment may be performed in separate furnaces in succession or in one furnace, whereby heat efficiency can be improved. This method is effective when a preliminary oxidation is performed so as only to accelerate carburization.

The above-described methods are examples for performing the present invention, and a method can be selected according to the purposes, the formations of furnaces in operation, the amount of circulation, and the like.

Type of Carburizing Gas

When carburizing gas is represented by $C_nH_m$, as shown by the formula 15, if m>0, the accelerating effect for carburization can be obtained regardless of the kind of carburizing gas (the value of n and m). That is, the effects of the present invention can be obtained by using hydrocarbons such as methane, ethane, propane, butane, ethylene, and acetylene, or carburizing gas including H in its molecular structure such as oil vapors, alcohols, and natural gases. In this case, in order to accelerate the reaction shown by the above formula 8 in the present invention, hydrocarbon gases represented by $C_nH_m$ are the most suitable. According to the formula 15, the effects increase with smaller m (in this case, m>0). Since hydrocarbon gas having m=1 does not exist, hydrocarbons having m=2 to 6, such as propane (m=6), ethylene (m=4), and acetylene (m=2) are effective. When carburizing gas having m=0 is used, the effects of the present invention cannot be obtained. For example, in a case of using CO or $CO_2$, the effects of the present invention cannot be obtained.

Temperature at Carburization

Theoretical background for explaining that the effects of the present invention can be obtained at any temperature of carburization, and the calculation results (Table 1) based thereon have already been described. An oxide film having a suitable thickness disclosed in the present invention has the effects even when the carburization temperature is changed. The minimum thickness of an oxide film limits the time required for reducing the oxide film, which is a part of the total time of the carburization reaction. When the total time of the carburization reaction is changed by changing the carburization temperature, the time required for reducing an oxide film is also changed at the same rate, whereby the ratio of both times is constant even when the temperature is changed. The above case can be applied to a case of the maximum thickness of an oxide film. The maximum thickness of an oxide film is defined by the barrier property with respect to the diffusion of carbon during carburization. When the diffusion property of carbon is changed by the change of the temperature, the amount of carbon produced by carburization reaction is also changed at the same rate, whereby the ratio thereof is constant.

C. Method for Performing Partial Carburization

By forming an oxide film on a portion of a product by the present invention, a product in which the carburization depth differs in portions can be produced. In the easiest method, after a work is preliminary oxidized, the oxide film of portions that do not require the oxide film are removed by grinding or cutting. Partial carburization can be performed by this method more easily than by conventional methods such as a partial carburization using an anti-carburizer (disclosed in Japanese Unexamined Patent Application Publication No. 10-273771 and Japanese Unexamined Patent Application Publication No. 4-32527), a partial carburization using plating (disclosed in Japanese Unexamined Patent Application Publication No. 8-60335), a method for controlling a carburization depth by utilizing plastic deformation (disclosed in Japanese Unexamined Patent Application Publication No.

5-25610), and a method in which unnecessary portions are removed by grinding or cutting after high concentration carburization (disclosed in Japanese Unexamined Patent Application Publication No. 4-250927).

Figure 8:
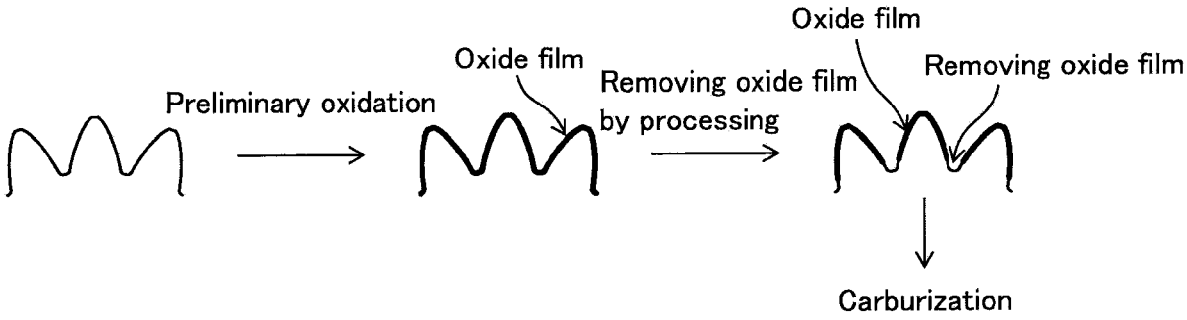
FIG. 8 is a figure showing an example in which partial carburization is performed on a gear wheel.
Figure 9:
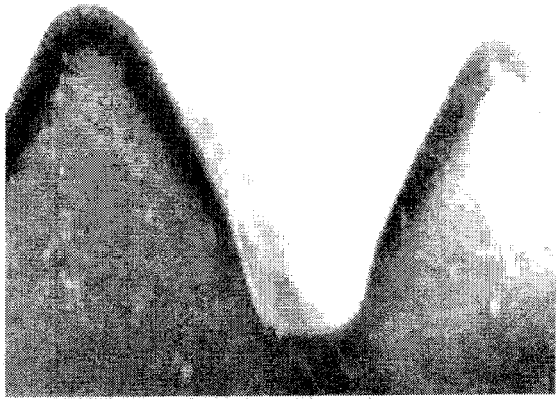
FIG. 9 is a photograph showing tooth portions of the gear wheel on which the partial carburization was performed as shown in FIG. 8.

FIG. 8 shows an example in which such a method of partial carburization is applied to a gear wheel. Thus, carburization depth at surfaces of teeth can be made greater than that at bottoms of the teeth by forming an oxide film on the surfaces of the teeth and removing the oxide film at the bottoms thereof, whereby a gear wheel having such a structure can be formed. FIG. 9 shows a photograph of teeth portions of a gear wheel on which the above method was performed. The material of the gear wheel is SCM420H. As shown in FIG. 9, the black areas of the surfaces are carburized parts, the bottom of the teeth in which an oxide film was removed has a thin carburized layer, and the carburized layer increases toward the top of the teeth.

When such a gear wheel is carburized by conventional decompressed carburization, the edge portion thereof may be excessively carburized. However, if decompressed carburization is performed by forming an oxide film at flat portions and removing the oxide film at the edge portions, the above problem does not occur.

D. Method for Forming a Structure in which Carbon are Dispersed

Figure 10:
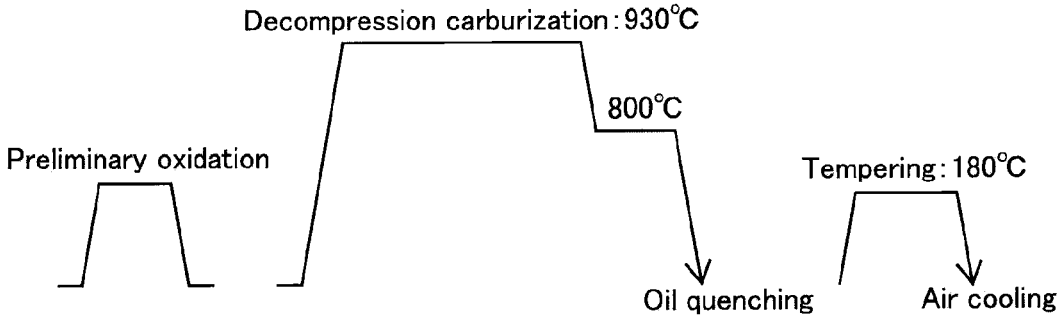
FIG. 10 is a diagram showing an example of a heating pattern when a treatment for precipitating carbon is performed.
Figure 11:
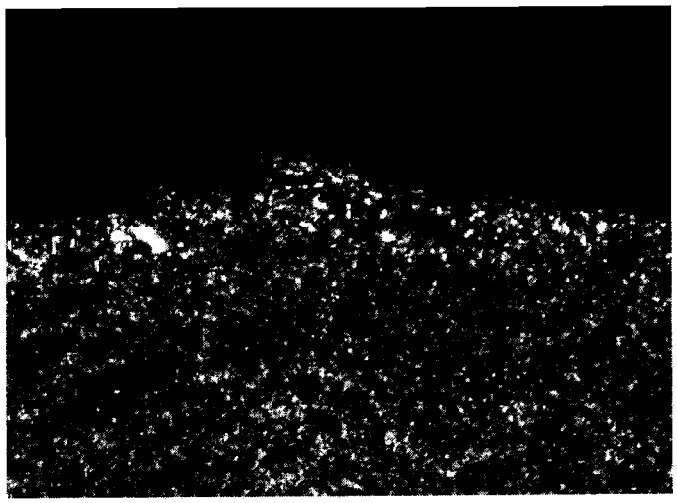
FIG. 11 is a photograph of an enlarged cross section of a steel material in which carbides were precipitated.

When a material is carburized by a step using the preliminary oxidation of the present invention so as to have a carbon concentration of not less than that at which carbides are produced, for example, C=at least 0.8%, and it is maintained at a precipitation temperature of carbides, a structure in which carbides are precipitated can be obtained. For example, when SCM420H is used, the above structure can be obtained by heat treatment using a heating pattern shown in FIG. 10. FIG. 11 shows an example of SCM420H in which carbides were precipitated by using such a method in practice.

Wear resistance and surface fatigue strength can be improved by precipitating carbides, but such high concentration carburization performed by conventional production methods takes time. On the other hand, a certain structure can be easily obtained by using the method of the present invention. For example, after forming an oxide film on a surface of a tooth and removing the oxide film at the bottom of the tooth, the root of the tooth, or the bottom and the root of the tooth according to the method of partial carburization described above, the tooth is carburized by using the heating pattern shown in FIG. 10. As a result, only the surface of the tooth, which requires pitting strength, can be carburized at high concentration, whereas decrease of impact strength caused by the formation of carbides does not occur at the bottom of the tooth or the root of the tooth, nor does it occur at the bottom and the root of the tooth.

E. Method for Producing Austenite by Controlling Carbon Concentration

Figure 12:
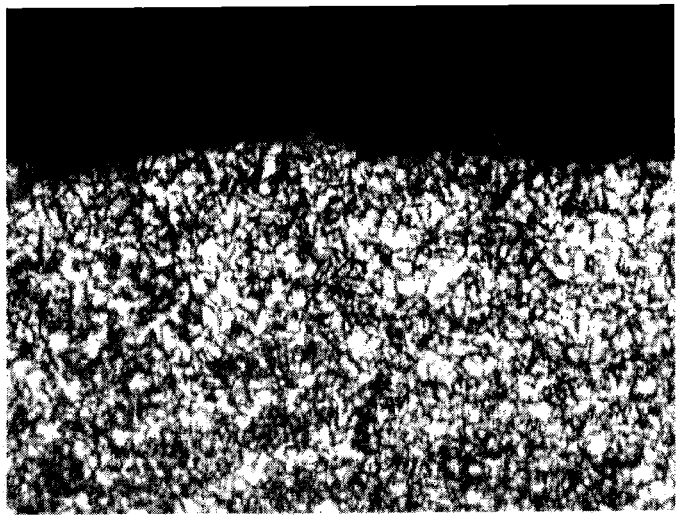
FIG. 12 is a photograph of an enlarged cross section of an austenitized steel material.

Increasing of carbon concentration by the step using the preliminary oxidation of the present invention improves austenite stability, and the amount of the austenite after quenching is controllable and can be increased. FIG. 12 shows an example of SCM420H in which an austenite structure is formed by such a method. Austenite structure can be partially formed by performing the above-described partial oxidation. In a gear wheel, by forming an austenite structure only at the bottom of the tooth by such a method, toughness of the root of the tooth is improved, and impact strength can be increased, and strength with respect to surface pressure at the surface of the tooth is maintained. Moreover, fatigue strength at the root of a tooth can be extremely improved by spraying hard media on the surface thereof and hitting the surface so as to produce deformation-induced transformed martensite at the bottom thereof.

What is claimed is:

1. A method for producing a carburized part by carburizing a steel member under a vacuum in a decompression furnace while feeding carburizing gas, comprising:

a step for forming an oxide film on at least a part of a surface of the steel member;

a step for generating carbon by reducing the oxide film with the carburizing gas; and a step for carburizing the surface of the steel member including the oxide film under a vacuum by diffusing the carbon, wherein the thickness of the oxide film is 0.05 to 5 μm.

* * * * *